United States Patent [19]

Muzyka et al.

[11] 4,030,946

[45] June 21, 1977

[54] ELIMINATING PRIOR PARTICLE BOUNDARY DELINEATION

[75] Inventors: Donald R. Muzyka, Reinholds; Robert F. Walley, Shoemakersville, both of Pa.

[73] Assignee: Carpenter Technology Corporation, Reading, Pa.

[22] Filed: Apr. 13, 1976

[21] Appl. No.: 676,508

[52] U.S. Cl. ..... 148/11.5 P; 75/223; 75/224; 148/31

[51] Int. Cl.[2] ..... B22F 1/04

[58] Field of Search ..... 148/11.5 P, 126; 75/.5 B, .5 BA, .5 BB, .5 BC, 223, 224; 29/182.7, 420.5

[56] References Cited

UNITED STATES PATENTS

| | | | |
|---|---|---|---|
| 3,653,982 | 4/1972 | Prill | 148/126 |
| 3,720,551 | 3/1973 | Allen | 75/224 |
| 3,802,938 | 4/1974 | Collins et al. | 148/126 |
| 3,884,676 | 5/1975 | Nadkarni et al. | 148/11.5 P |
| 3,890,816 | 6/1975 | Allen et al. | 75/.5 BA |
| 3,953,205 | 4/1976 | Cox et al. | 148/126 |

OTHER PUBLICATIONS

Metals Engineering Quarterly, Nov. 1974, pp. 47–49.

*Primary Examiner*—W. Stallard
*Attorney, Agent, or Firm*—Edgar N. Jay

[57] ABSTRACT

The process prevents prior powder particle boundary delineation by providing one or more surfactant elements which prevent nucleation of carbides at the particle surfaces with the result that carbide precipitation occurs within the powder particles rather than predominantly at the particle surfaces. In one embodiment, a small but effective amount of one or more surfactants is added to prealloyed powder before the powder is enclosed and densified at elevated temperature. In another embodiment, the surfactant is added to the melt of the prealloyed powder prior to atomization. The surfactant should be capable of forming a vapor under the conditions of hot densification, should be a strong oxide and/or sulfide former, must be a weak carbide former, should form oxides and/or sulfides which will not nucleate carbides of other elements, and which, if present in the article made from the powder, will not objectionably affect the desired properties. Useful surfactants include magnesium, barium, calcium, cerium, lanthanum, lithium, neodymium, praseodymium, yttrium, and misch metal.

23 Claims, 3 Drawing Figures

ELIMINATING PRIOR PARTICLE BOUNDARY DELINEATION

BACKGROUND OF THE INVENTION

This invention relates to powder metallurgy and, more particularly, to a method for substantially eliminating the precipitation of carbides at prior powder particle boundaries in articles made by powder metallurgy.

The undesired formation of carbides at prior particle boundaries occurs during powder metallurgy processes after the powdered alloy has been heated above the carbide solvus temperature. When the microstructure of the cooled alloy is examined, the prior particle boundaries can be seen distinctly delineated. And upon further examination, it has been determined that the materials which delineate boundaries are mainly reprecipitated carbides. Here and throughout this application it is intended by the term "carbides" to include compounds of carbon with one or more metals with or without one or more nonmetals such as oxygen, sulfur and nitrogen.

It is not completely understood why such carbides form at the prior particle boundaries. When the alloy is heated above the carbide solvus temperature, the carbides within the powder particles go into solid solution. When the temperature is then lowered below the carbide solvus temperature, carbides reprecipitate. While at elevated temperature, the powder particles are ideally desired to fuse together to form a solid, unitary article without the particles themselves melting. When the carbides precipitate along what had been the particle boundaries rather than remaining more homogeneously distributed within the particles, the resulting article does not have the desired properties, as evidenced most notably by low ductility in directions perpendicular to the delineated prior boundaries. Furthermore, it has been found that alloys which are vulnerable to sulfidation attack, which is particularly undesirable in products such as components of engines which burn fuels containing sulfur are improved by the present process.

One method for solving the problem of boundary delineation is proposed in Allen U.S. Pat. No. 3,890,816, June 24, 1975, relating to the elimination of carbide segregation to prior particle boundaries in nickel-base alloys by means of adding a strong MC-type carbide former selected from the group consisting of columbium, tantalum, hafnium and zirconium to the alloy melt. The added carbide formers seem to prevent boundary delineation by strongly binding the carbon within the particles, thus preventing carbide precipitation at the boundaries. However, this requires adding a significant amount of such carbide formers, which substantially alters the composition of the treated alloys and which in turn may significantly affect the alloys' properties or may result in different properties, so that the modified composition may not receive the same acceptance in industry as the unmodified alloys. In the case of superalloys for aircraft engines this is a particularly serious problem, since under existing regulations concerning qualification testing, such modified alloys cannot be used in many of their intended applications without extensive and costly testing to determine the properties of articles made from the new alloy.

The same solution was subsequently published in *Metals Engineering Quarterly*, Nov. 1974, pages 47–49.

SUMMARY OF THE INVENTION

It is, therefore, a principal object of this invention to provide a process for minimizing or substantially eliminating carbide precipation at prior powder particle boundaries (boundary delineation) in alloy articles made by powder metallurgy techniques without significantly changing the alloy composition.

It is a further object to provide articles made in accordance with the process of this invention.

The present invention stems from our discovery that undesirable carbides, which we believe to be of the MC type, form at the powder particle boundaries because sites on the surfaces of the particles act to nucleate carbides, and that the addition of small amounts of certain elements which we term "surfactants" effectively eliminates boundary delineation. We believe that this is at least partially because the surfactant elements act to change the free energy relationships at the surfaces of the powder particles, possibly by reacting preferentially with sulfides and oxides which otherwise would be free to act as carbide nucleators, thus, in effect, deactivating nucleating sites on the particle surfaces.

One or more of the elements magnesium, barium, calcium, cerium, lanthanum, lithium, neodymium, praseodymium, yttrium, and misch metal are preferably used as surfactants in carrying out the method of this invention. Other rare earth elements may also be used but their high cost is a drawback. Potassium can also be used as a surfactant to reduce boundary delineation, but appears to be less effective than the preferred surfactants.

In carrying out the method of the present invention, a small but effective amount of at least one of the surfactants as defined herein is provided so that when an alloy powder is heated above and then cooled below the carbide solvus temperature incidental to densification of the powder to form the desired article, boundary delineation is substantially eliminated. The amount of surfactant required to prevent prior boundary delineation is readily determined and is small enough that the composition of the alloy is not changed significantly. The manufacture of articles using powder metallurgy techniques in all other respects may proceed as desired.

DESCRIPTION OF THE DRAWINGS

Further advantages, as well as objects, of the present invention will be apparent from the following detailed description thereof and the accompanying drawing in which.

DESCRIPTION OF THE PREFERRED EMBODIMENTS

Figure 1:
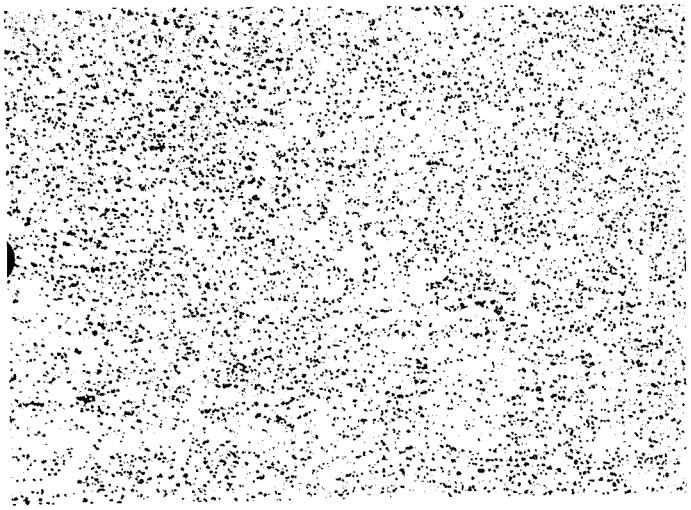
FIG. 1 is a view showing a photomicrograph of the grain structure enlarges 200 times, of an article made from alloy powder in accordance with the present invention.

The process of the present invention is advantageously used in the production of a wide variety of articles prepared from prealloyed powder having widely different compositions. As is well known, the composition of the alloy from which the prealloyed powder is prepared is selected so as to provide the properties desired in the finished article. As will be pointed out more fully hereinbelow, the surfactant, as defined herein, can be included in the composition at the time the alloy is melted using well-known conventional melting techniques. However, particularly in the case of the more volatile surfactants, best results are attained when, as is preferred, the surfactant is added to the prealloyed powder prior to densification. The alloy powder can be prepared in any manner desired which is compatible with the properties desired in the finished article as is well known. For example, following preparation of the molten alloy, it can be atomized by any desired technique, either a gaseous or liquid atomizing fluid can be used. The particle size distribution is not critical but the particle size or distribution of particle sizes is preferred which favors close packing ratios to facilitate obtaining 100% or close to 100% of theoretical density.

In some instances, it may be desirable to remove excessively large particles, but in general, good results can be attained with a wide range of particle sizes. In accordance with good powder metallurgy techniques, the powder to be used should be well mixed and should not contain areas which are predominantly of only one size or of a narrower range of particle sizes than the remainder.

Surfactant in elemental form or mixed or combined with other tolerable elements or compounds is added to the alloy powder in any convenient way. When relatively small batches of alloy powder are to be densified, the required amount of surfactant may be conveniently handled and added in the form of one or more relatively large lumps. Surfactant in lump form is believed to work well because the surfactant is believed to be present in vapor form at the elevated temperature to which the alloy powder is heated for densification. Best results have been attained when the surfactant has been added as a powder. In the case of the larger masses of powder, as when large shapes weighing about 50 pounds (9.1 kg) or more are to be formed, surfactant powder screened to about −100 mesh (U.S.S.) should give best results but powder as fine as −325 mesh has given good results. When surfactant powder is used, it is thoroughly mixed with the alloy powder to facilitate the presence of the surfactant in its active form throughout the powder mass when the latter is heated.

While the mechanism by which prior boundary delineation is prevented is not fully understood, the data we have collected indicates that nucleation of the carbides which hitherto have delineated the prior powder particle boundaries is prevented where a critical minimum amount of the surfactant is present at the powder particle surfaces. The best explanation of the phenomenon now known to us is that the surfactant acts to deactivate sites which we believe are related to such sulfur and oxygen as may be present and which otherwise would serve to nucleate the unwanted carbides. Thus, in accordance with the present invention, by surfactant it is intended to include elements which would vaporize and thus are capable of being present as a vapor under the conditions which obtain during or incident to hot densification, which are strong oxide and/or sulfide formers, which are weak carbide formers, which do not form oxides or sulfides which in turn would nucleate carbides of other elements present in the alloy composition, and which when present in the end product will not detrimentally affect the desired properties thereof. It is also desirable that the surfactant element not be dangerous in use or when present in the end product, and its use should not be too costly. While the surfactant element or elements can be incorporated in the prealloyed powder when the alloy is melted and atomized, best results are attained when the surfactant in the form of a fine powder is mixed with the prealloyed powder before it is sealed in an enclosure for densification.

In use, magnesium has given best results, and therefore, is most preferred. Because magnesium and the elements useful as surfactants in accordance with the present invention are highly reactive, it is necessary to take into account the amount of impurities such as oxygen as well as other elements that may be present which would, in reacting with the surfactant, in effect, consume so much of it that the remaining amount will not be effective to prevent boundary delineation. Thus, in specifying the minimum amount of magnesium and other surfactant elements to be used in accordance with the present invention it is not intended to include that amount thereof which is otherwise consumed. When, because of the melting practice followed in making the alloy or the atomizing process used in making powder therefrom, substantial amounts of such elements as oxygen or other reactive impurities are introduced then it is preferred to reduce substantially the amount present. For example, in the case of oxygen which may be introduced when the atomizing fluid used is water, the powder can be substantially deoxidized by heating in hydrogen or cracked ammonia.

When hot densifying prealloyed powder atomized by means of an inert fluid such as argon from an alloy melted under conditions substantially free of oxygen such as are provided by vacuum induction melting techniques, an addition of 0.01 weight percent (w/o) magnesium would be effective under conditions of high purity. A minimum of about 0.013 w/o magnesium would be effective to prevent boundary delineation under less stringent conditions of high purity. Preferably, about 0.03 w/o and better yet about 0.05 w/o magnesium is used to ensure complete elimination of boundary delineation when the usual amount of surfactant-consuming impurities are present. While larger amounts of the surfactant may be used, once an amount sufficient to prevent boundary delineation entirely is added any excess would be tolerable so long as it had no undesired effect.

Other elements which have been found useful as surfactants in accordance with the present invention are barium, calcium, cerium, lanthanum, lithium, neodymium, praseodymium, yttrium and the commercially available mixture of rare earth elements known as misch metal which primarily is made up of cerium and lanthanum. On the other hand, zirconium which has many of the properties desired in a surfactant but is a strong carbide former did not work to prevent boundary delineation. The amount of each of the foregoing surfactants effective to prevent all boundary delineation is readily determined by taking an amount which is the stoichiometric equivalent of the effective amount of magnesium. Though less precise, the calculation is facilitated by selecting an amount which is in the same proportion to 0.05 w/o magnesium as the atomic weight of the element bears to that of magnesium. For example, the amount of barium to be used to have an effect close to that of 0.05 w/o magnesium is readily determined by multiplying the ratio of the atomic weights of barium to that of magnesium by the weight percent of magnesium. Thus, about 0.28 w/o barium can be used instead of about 0.05 w/o magnesium. However, transport rates, vapor pressure and other properties under the conditions prevailing during hot densification can in practice require an adjustment of the precise amount required to give the best results. Potassium can also be used as the surfactant to reduce boundary delineation, but appears to be less effective than the foregoing surfactants.

Whether finely divided, in lumps or other form, the surfactant and the prealloyed powder are placed in an enclosure which is preferably, but not neccessarily, evacuated before being sealed. This is conveniently carried out by placing the prealloyed powder and the surfactant in a readily deformable container made of material compatible with the powder and which, upon completion of densification, can be readily removed. Thin-walled metal containers which closely fit the volume of powder to be densified therein have given good results. As is well known, the temperature range at which hot densification is carried out is determined at least in part by the composition of the alloy. It is not desired to melt the powder and, therefore, the maximum usable temperature is sufficiently below the solidus temperature of the alloy to ensure against local melting. The specific manner in which hot densification is carried out forms no part of the present invention except that it is believed to be necessary to achieve best results that the temperature be high enough to vaporize the surfactant during the process and that densification be carried out so that about 99% or more of theoretical density be achieved at least in those portions of the densified article in which boundary delineation is not wanted.

The following examples are illustrative of the present invention and, unless otherwise indicated, were each carried out using conventional practices.

EXAMPLE 1

About 10 lbs. (4.54 kg) of prealloyed powder of −60/+325 mesh (U.S.S.) particle size and having the following composition in weight percent were mechanically blended with −325 mesh magnesium powder to provide in the mixture a magnesium content of about 0.05% by weight.

| | w/o |
|---|---|
| Carbon | 0.166 |
| Manganese | <.01 |
| Silicon | 0.01 |
| Sulfur | <.001 |
| Chromium | 8.98 |
| Molybdenum | 2.46 |
| Cobalt | 14.36 |
| Vanadium | 0.89 |
| Titanium | 4.81 |
| Aluminum | 5.53 |
| Boron | 0.015 |
| Iron | 0.05 |
| Zirconium | 0.062 |

Figure 2:
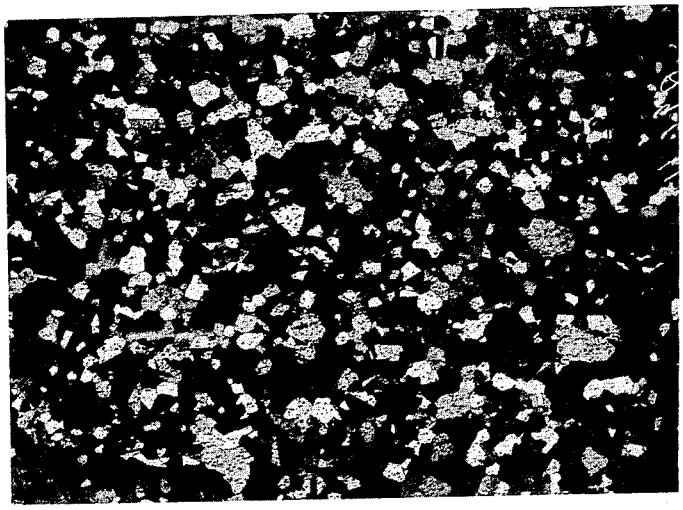
FIG. 2 is a similar view showing the grain structure enlarged 100 times of a heat treated and etched sample having the same composition and prepared in the same manner as the specimem shown in FIG. 1.

The balance was nickel and 29 parts per million (ppm) of oxygen, 10 ppm nitrogen and inconsequential impurities. A stainless steel can, made of A.I.S.I. Type 304, was filled with the substantially homogeneously blended mixture and was then evacuated, as is preferred, to about $5\times10^{-3}$ mm Hg and sealed. The sealed container was heated long enough for it and its contents to be brought to a temperature of about 2150° F (about 1177° C) and then extruded to provide a 10:1 reduction. The extruded billet was trimmed and then sections were prepared from various parts of the billet for microscopic examination. All were found to be free of delineated boundaries. A 200× micrograph prepared from one of the unetched specimens is shown in FIG. 1. Another specimen prepared in the same manner then heated at 2275° F (1246° C) for 24 hours, air cooled and then etched is shown enlarged 100× in FIG. 2.

Figure 3:
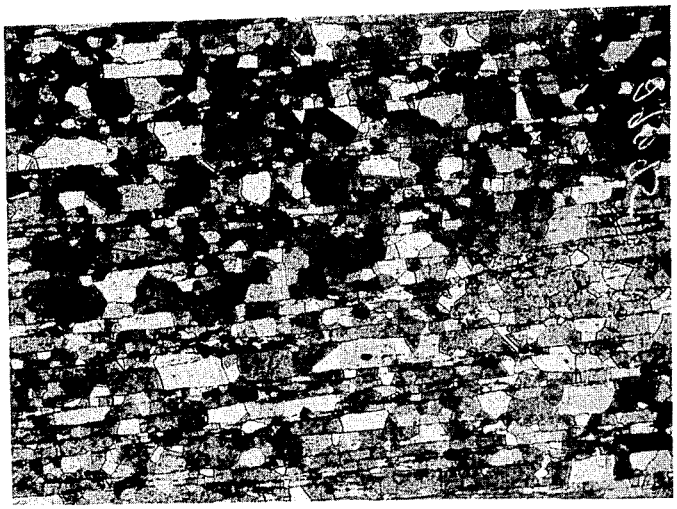
FIG. 3 is a view similar to FIG. 2 showing the grain structure of a specimen having substantially the same composition as the specimens of FIGS. 1 and 2, and showing the prior boundary delineation characteristic of the prior art.

For purposes of comparison, a specimen was prepared from a billet which had been prepared in the same manner as that used in Example 1 except that no surfactant was added. The prealloyed powder used had the same composition and had been prepared at the same time as the powder used to make the billet of Example 1. The specimen was heat treated and etched as described in connection with the specimen shown in FIG. 2 and is shown in FIG. 3 enlarged 100×. The prior powder particle boundary delineation characteristic of the prior art can be clearly seen.

Stress rupture specimens, both smooth and combination smooth and notched, prepared from the billet of Example 1, which retained 0.037 w/o of the 0.05 w/o magnesium that had been added to the container prior to densification, were tested at 1350° F (732° C) under a load of 100,000 psi (7030.7 kg/cm²). The smooth test specimen had a life of 61 hours, a 6% elongation and a 9% reduction in area. The combination test specimen had a life of 47 hours, a 5% elongation and an 11% reduction in area. The material from which the micrograph shown in FIG. 3 was prepared when similarly tested using combination smooth and notched test specimens gave an average from two tests of 41 hours stress rupture life, 4.5% elongation and 10% reduction in area.

In carrying out the following examples, prealloyed powder was used having the following composition

TABLE I

| | w/o |
|---|---|
| Carbon | 0.17 |
| Silicon | 0.01 |
| Sulfur | 0.002 |
| Chromium | 8.99 |
| Molybdenum | 2.47 |
| Titanium | 4.79 |
| Aluminum | 5.60 |
| Cobalt | 14.14 |
| Vanadium | 0.90 |
| Zirconium | 0.07 |
| Boron | 0.012 |
| Iron | 0.06 |

The balance was nickel except for incidental impurities which included 23 ppm oxygen and 10 ppm nitrogen. Each of the following surfactants in powder form, except for barium and calcium which were in rod form, were measured out to provide an amount equivalent on an atomic weight basis to 0.05 w/o magnesium in 5 lbs (2.27 kg) of the prealloyed powder. It may be noted that surfactants which had been oil packed were washed with chloroform and ether, care being taken to minimize exposure to the atmosphere. The surfactants used were barium, calcium, cerium, lanthanum, lithium, neodymium, praseodymium, yttrium and misch metal, the latter being a well known mixture of rare earths made up mostly of cerium and lanthanum. The weighed out powder samples of Ce, La, Li, Nd, Pr, Y, and misch metal were each blended with 5 lbs of the prealloyed powder under an argon atmosphere to minimize oxidation and then each blend was used to fill a 3 inch (7.62 cm) by 5 inch (12.7 cm) long Type 304 stainless steel can having a wall thickness of 0.25 inch (0.64 cm). The Ba and Ca in rod form were placed in the bottom of their respective cans before the cans were filled with the 5 lbs of prealloyed powder. The filled cans were outgassed and sealed. The sealed cans were heated to 2150° F (1177° C) and then reduced 10:1 by extending down to 1.04 inch (2.64 cm) round.

In Table II below, the amount of each of the surfactants added, the amount retained in the extruded specimens as well as the nitrogen, oxygen and hydrogen contents are indicated in weight percent or parts per million.

TABLE II

| Ex. No. | Surfactant | Added (w/o) | Retained (w/o) | N (w/o) | O (ppm) | H (ppm) |
|---|---|---|---|---|---|---|
| 2 | Ba | 0.28 | 0.04 | 0.001 | 49 | 8 |
| 3 | Ca | 0.08 | 0.03 | 0.001 | 43 | 11 |
| 4 | Ce | 0.29 | 0.21 | 0.001 | 62 | 5 |
| 5 | La | 0.29 | 0.40 | 0.002 | 74 | 4 |
| 6 | Li | 0.014 | <.01 | 0.001 | 71 | 11 |
| 7 | Nd | 0.30 | 0.30 | 0.001 | 73 | 4 |
| 8 | Pr | 0.29 | 0.25 | 0.001 | 82 | 7 |
| 9 | Y | 0.18 | 0.12 | 0.004 | 66 | 6 |
| 10 | Misch metal | 0.29 | * | 0.001 | 477 | 6 |

*0.14 w/o Ce and 0.14 w/o La were found.

The indicated retained level of lanthanum greater than the amount added is believed to have been the result of local segregation. The high oxygen content coupled with the normal nitrogen content found in Example 10 is believed to indicate the misch metal as added contained rare earth oxides. Specimens prepared from each of the extrusions of Examples 2–10 were found to demonstrate that in each boundary delineation had been eliminated.

For further comparison, an identical process was carried out using an addition of 0.19 w/o zirconium powder having a particle size of −325 (U.S.S.). The zirconium bearing product showed substantially the same prior powder particle boundary delineation characteristic of the prior art.

EXAMPLES 11 AND 12

To illustrate another embodiment of the process of the present invention, a 100 lb (45.36 kg) vacuum induction melted ingot having the composition indicated for Example 11 in Table III below (w/o unless otherwise indicated) was remelted and 0.15 w/o magnesium in the form of NiMg was added to the melt just prior to atomization. The same procedure was followed with respect to Example 12 but 0.30 w/o magnesium in the form of NiMg was added to the melt.

TABLE III

| | Ex. No. 11 | Ex. No. 12 |
|---|---|---|
| C | 0.174 | 0.190 |
| Mn | <.01 | <.01 |
| Si | <.01 | 0.02 |
| S | <.001 | <.001 |
| Cr | 8.61 | 8.56 |
| Mo | 2.44 | 2.43 |

TABLE III-continued

| | Ex. No. 11 | Ex. No. 12 |
|---|---|---|
| Co | 14.40 | 14.25 |
| V | 0.89 | 0.89 |
| Ti | 4.79 | 4.74 |
| Al | 5.52 | 5.39 |
| B | 0.01 | 0.02 |
| Fe | 0.07 | 0.04 |
| Zr | 0.067 | 0.068 |
| O(ppm) Powder | 40 | 42 |
| Extruded Bar | 122 | 150 |
| N(ppm) | 20 | 10 |
| Mg added to the melt | 0.15 | 0.30 |
| Retained in Powder | 0.055 | 0.099 |
| Retained in Extruded Bar | 0.049 | 0.074 |

The balance of the composition in each case was nickel plus inconsequential impurities.

The prealloyed powder thus produced was sealed in cans as was described in connection with Example 1 and reduced 10:1 by extrusion as previously described. Specimens for microscopic examination were prepared and examined as described in connection with the previous examples and the material was found free of delineated boundaries.

Stress rupture specimens, both smooth and combination smooth and notched, prepared from the extruded bars of Examples 11 and 12 were tested at 1350° F (732° C) under a load of 100,000 psi (7030.7 kg/cm²). The results of the tests are given in Table IV.

TABLE IV

| Ex. No. | Specimen Type | Life (hrs.) | Elong. (%) | R.A. (%) |
|---|---|---|---|---|
| 11 | Smooth | 39 | 6 | 7 |
| | Combo. | 40 | 4 | 8 |
| 12 | Smooth | 36 | 4 | 4 |
| | Combo. | 39 | 5 | 6 |

While the present invention has been illustrated by means of one of the so-called superalloys, it is not intended thereby to limit the scope of the invention. As was noted hereinabove, the present invention is useful in eliminating boundary delineation in a wide range of compositions. It can be used in connection with any composition susceptible to boundary delineation with a minimum of change to the composition and its properties. The process can be used in treating alloys of one or more of the transition metals iron, nickel or cobalt, including the precipitation hardening superalloys, tool steels, the nickel-iron electronic alloys, and stainless steels. All such alloys, as a practical matter, contain at least about 0.005% carbon. The process of the present invention is particularly useful in preventing boundary delineation in precipitation hardening alloys containing about 0.01 to 0.50% carbon, up to about 2.0% manganese, up to about 1.0% silicon, up to about 25% chromium, about 20 to 80% nickel, up to about 60% iron, up to about 25% cobalt, up to about 12% molybdenum, up to about 8% tungsten, about 0.5 to 10% titanium, about 0.2 to 10% aluminum, up to about 7% niobium, about 0.002 to 0.30% boron, up to about 10% tantalum, up to about 0.50% zirconium, up to about 3.0% hafnium, up to about 5.0% rhenium and up to about 1.5% vanadium. Illustrative of alloys included in the foregoing are the following which contain about

| | Alloy A | Alloy B | Alloy C | Alloy D |
|---|---|---|---|---|
| C | 0.02–0.06 | 0.05–0.09 | 0.04–0.09 | 0.15–0.20 |

-continued

| | Alloy A | Alloy B | Alloy C | Alloy D |
|---|---|---|---|---|
| Mn | 0.15 Max. | 0.02 Max. | 0.15 Max. | 0.02 Max. |
| Si | 0.20 Max. | 0.10 Max. | 0.20 Max. | 0.02 Max. |
| Cr | 14–16 | 11.9–12.9 | 12–14 | 8–11 |
| Co | 16–18 | 18–19 | 7–9 | 13–17 |
| Mo | 4.5–5.5 | 2.8–3.6 | 3.3–3.7 | 2–4 |
| W | — | — | 3.3–3.7 | — |
| Ti | 3.35–3.65 | 4.15–4.50 | 2.3–2.7 | 4.50–5.0 |
| Al | 3.85–4.15 | 4.80–5.15 | 3.3–3.7 | 5.0–6.0 |
| Nb | — | — | 3.3–3.7 | — |
| B | 0.02–0.03 | 0.016–0.024 | 0.006–0.015 | 0.01–0.02 |
| V | — | 0.58–0.98 | — | 0.70–1.20 |
| Zr | 0.06 Max. | 0.04–0.08 | 0.03–0.07 | 0.03–0.09 |
| Fe | — | 1 Max. | — | 1 Max. |

and the balance nickel plus incidental impurities.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method for substantially eliminating prior powder particle boundary delineation in articles made from prealloyed powder densified to at least about 99% of theoretical density which includes placing in an enclosure a predetermined amount of the prealloyed powder with a predetermined amount of a surfactant and having substantially less then theoretical density, said surfactant comprising at least one metallic element which is a strong oxide and sulfide former and a weak carbide former as compared to the elements of said prealloyed powder, heating said prealloyed powder and surfactant to a predetermined temperature above the carbide solvus temperature and below the solidus temperature of said prealloyed powder, and densifying said prealloyed powder while it is above said carbide solvus temperature to at least about 99% of theoretical density with said surfactant available at the surfaces of the powder particles.

2. The method set forth in claim 1 in which at least part of said surfactant is present in vapor form in said enclosure at said predetermined temperature.

3. The method set forth in claim 2 in which said surfactant is selected from the group consisting of magnesium, barium, calcium, cerium, lanthanum, lithium, neodymium, praseodymium, yttrium, misch metal and potassium.

4. The method set forth in claim 3 in which said enclosure is evacuated to substantially below atmospheric pressure and then sealed before said prealloyed powder is densified to at least 99% of theoretical density.

5. The method set forth in claim 3 in which said surfactant is added to said enclosure.

6. The method set forth in claim 3 in which said surfactant is added to the molten alloy from which said powder is made just before the powder is made therefrom.

7. The method set forth in claim 3 in which the alloy of said prealloyed powder comprises in weight percent about

| | w/o |
|---|---|
| Carbon | 0.005–0.50 Max. |
| Manganese | 2.0 Max. |
| Silicon | 1.0 Max. |

-continued

| | w/o |
|---|---|
| Chromium | 25 Max. |
| Nickel | 20–80 |
| Cobalt | 25 Max. |
| Molybdenum | 12 Max. |
| Tungsten | 8 Max. |
| Titanium | 0.5–10 |
| Aluminum | 0.2–10 |
| Niobium | 7 Max. |
| Boron | 0.002–0.30 |
| Tantalum | 10 Max. |
| Zirconium | 0.50 Max. |
| Hafnium | 3.0 Max. |
| Rhenium | 5.0 Max. |
| Vanadium | 1.5 Max. |
| Iron | 60 Max. |

8. The method set forth in claim 7 in which the alloy of said prealloyed powder comprises in weight percent about

| | w/o |
|---|---|
| Carbon | 0.02–0.06 |
| Manganese | 0.15 Max. |
| Silicon | 0.20 Max. |
| Chromium | 14–16 |
| Cobalt | 16–18 |
| Molybdenum | 4.5–5.5 |
| Titanium | 3.35–3.65 |
| Aluminum | 3.85–4.15 |
| Boron | 0.02–0.03 |
| Zirconium | 0.06 Max. |

9. The method set forth in claim 7 in which the alloy of said prealloyed powder comprises in weight percent about

| | w/o |
|---|---|
| Carbon | 0.05–0.09 |
| Manganese | 0.02 Max. |
| Silicon | 0.10 Max. |
| Chromium | 11.9–12.9 |
| Cobalt | 18–19 |
| Molybdenum | 2.8–3.6 |
| Titanium | 4.15–4.50 |
| Aluminum | 4.80–5.15 |
| Boron | 0.016–0.024 |
| Vanadium | 0.58–0.98 |
| Zirconium | 0.04–0.08 |
| Iron | 1 Max. |

10. The method set forth in claim 7 in which the alloy of said prealloyed powder comprises in weight percent about

| | w/o |
|---|---|
| Carbon | 0.04–0.09 |
| Manganese | 0.15 Max. |
| Silicon | 0.20 Max. |
| Chromium | 12–14 |
| Cobalt | 7–9 |
| Molybdenum | 3.3–3.7 |
| Tungsten | 3.3–3.7 |
| Titanium | 2.3–2.7 |
| Aluminum | 3.3–3.7 |
| Niobium | 3.3–3.7 |
| Boron | 0.006–0.015 |
| Zirconium | 0.03–0.07. |

11. The method set forth in claim 7 in which the alloy of said prealloyed powder comprises in weight percent about

| | w/o |
|---|---|
| Carbon | 0.15–0.20 |
| Manganese | 0.02 Max. |
| Silicon | 0.02 Max. |
| Chromium | 8–11 |
| Cobalt | 13–17 |
| Molybdenum | 2–4 |
| Titanium | 4.50–5.0 |
| Aluminum | 5.0–6.0 |
| Boron | 0.01–0.02 |
| Vanadium | 0.70–1.20 |
| Zirconium | 0.03–0.09 |
| Iron | 1 Max. |

12. A method for substantially eliminating prior powder particle boundary delineation in articles made from prealloyed powder densified to at least about 99% of theoretical density which includes placing in an enclosure a predetermined amount of the prealloyed powder with a predetermined amount of a surfactant and having substantially less then theoretical density, said surfactant comprising at least one element selected from the group consisting of magnesium, barium, calcium, cerium, lanthanum, lithium, neodymium, praseodymium, yttrium, misch metal and potassium, heating said prealloyed powder and surfactant to a predetermined temperature above the carbide solvus temperature and below the solidus temperature of said prealloyed powder, and densifying said prealloyed powder while it is above said carbide solvus temperature to at least about 99% of theoretical density with said surfactant available at the surfaces of the powder particles.

13. The method set forth in claim 12 in which said enclosure is evacuated to substantially below atmospheric pressure and then sealed before said prealloyed powder is densified to at least 99% of theoretical density.

14. The method set forth in claim 12 in which said surfactant is added to said enclosure.

15. The method set forth in claim 12 in which said surfactant is added to the molten alloy from which said powder is made just before the powder is made therefrom.

16. The method set forth in claim 12 in which the alloy of said prealloyed powder comprises in weight percent about

| | w/o |
|---|---|
| Carbon | 0.005–0.50 Max. |
| Manganese | 2.0 Max. |
| Silicon | 1.0 Max. |
| Chromium | 25 Max. |
| Nickel | 20–80 |
| Cobalt | 25 Max. |
| Molybdenum | 12 Max. |
| Tungsten | 8 Max. |
| Titanium | 0.5–10 |
| Aluminum | 0.2–10 |
| Niobium | 7 Max. |
| Boron | 0.002–0.30 |
| Tantalum | 10 Max. |
| Zirconium | 0.50 Max. |
| Hafnium | 3.0 Max. |
| Rhenium | 5.0 Max. |
| Vanadium | 1.5 Max. |
| Iron | 60 Max. |

17. The method set forth in claim 16 in which the alloy of said prealloyed powder comprises in weight percent about

| | w/o |
|---|---|
| Carbon | 0.02–0.06 |
| Manganese | 0.15 Max. |
| Silicon | 0.20 Max. |
| Chromium | 14–16 |
| Cobalt | 16–18 |
| Molybdenum | 4.5–5.5 |
| Titanium | 3.35–3.65 |
| Aluminum | 3.85–4.15 |
| Boron | 0.02–0.03 |
| Zirconium | 0.06 Max. |

18. The method set forth in claim 16 in which the alloy of said prealloyed powder comprises in weight percent about

| | w/o |
|---|---|
| Carbon | 0.05–0.09 |
| Manganese | 0.02 Max. |
| Silicon | 0.10 Max. |
| Chromium | 11.9–12.9 |
| Cobalt | 18–19 |
| Molybdenum | 2.8–3.6 |
| Titanium | 4.15–4.50 |
| Aluminum | 4.80–5.15 |
| Boron | 0.016–0.024 |
| Vanadium | 0.58–0.98 |
| Zirconium | 0.04–0.08 |
| Iron | 1 Max. |

19. The method set forth in claim 16 in which the alloy of said prealloyed powder comprises in weight percent about

| | w/o |
|---|---|
| Carbon | 0.04–0.09 |
| Manganese | 0.15 Max. |
| Silicon | 0.20 Max. |
| Chromium | 12–14 |
| Cobalt | 7–9 |
| Molybdenum | 3.3–3.7 |
| Tungsten | 3.3–3.7 |
| Titanium | 2.3–2.7 |
| Aluminum | 3.3–3.7 |
| Niobium | 3.3–3.7 |
| Boron | 0.006–0.015 |
| Zirconium | 0.03–0.07. |

20. The method set forth in claim 16 in which the alloy of said prealloyed powder comprises in weight percent about

| | w/o |
|---|---|
| Carbon | 0.15–0.20 |
| Manganese | 0.02 Max. |
| Silicon | 0.02 Max. |
| Chromium | 8–11 |
| Cobalt | 13–17 |
| Molybdenum | 2–4 |
| Titanium | 4.50–5.0 |
| Aluminum | 5.0–6.0 |
| Boron | 0.01–0.02 |
| Vanadium | 0.70–1.20 |
| Zirconium | 0.03–0.09 |
| Iron | 1 Max. |

21. The article made by the method of claim 1.

22. The article made by the method of claim 3.

23. The article made by the method of claim 12.

* * * * *

UNITED STATES PATENT OFFICE

CERTIFICATE OF CORRECTION

PATENT NO. : 4,030,946

DATED : June 21, 1977

INVENTOR(S) : Donald R. Muzyka and Robert F. Walley

It is certified that error appears in the above-identified patent and that said Letters Patent are hereby corrected as shown below:

Col. 1, line 51, after "melt" insert "*";
line 67, before "The" insert "*".
Col. 2, line 56, for "enlarges" read -- enlarged --;
line 62, for "specimem" read -- specimen --.
Col. 7, line 17, for "extending" read -- extruding --.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*